United States Patent [19]

Lucero

[11] 4,074,364

[45] Feb. 21, 1978

[54] HOLD-DOWN DEVICE FOR SHIRTS AND THE LIKE

[76] Inventor: Gerald N. Lucero, 4161 E. Mission, No. 17, Pomona, Calif. 91766

[21] Appl. No.: 693,340

[22] Filed: June 7, 1976

[51] Int. Cl.[2] ..... A41B 3/04

[52] U.S. Cl. ..... 2/117

[58] Field of Search ..... 2/117, 77, 403, 404, 2/405, 406, 407, 312, 313, 78 B, 78 D, 300; 128/524, 528

[56] References Cited

U.S. PATENT DOCUMENTS

| | | | |
|---|---|---|---|
| 862,010 | 7/1907 | Newton | 2/312 |
| 932,640 | 8/1909 | Pfiffner | 2/117 |
| 1,255,555 | 2/1918 | Neusky | 2/312 |
| 1,998,085 | 4/1935 | Jones | 2/78 B |
| 2,727,247 | 12/1955 | Bailey | 2/323 |

*Primary Examiner*—Werner H. Schroeder
*Assistant Examiner*—Doris L. Troutman
*Attorney, Agent, or Firm*—John H. Crowe

[57] ABSTRACT

A hold-down device for shirts, blouses, etc., comprising an elastic hipband to be worn around the hips, elastic front and rear flaps secured to the hipband and converging downwardly to fit the crotch of the wearer. Upstanding tabs are spaced around the hipband with means for securing the lower portion of a shirt to the tabs.

6 Claims, 8 Drawing Figures

FIG. 1.
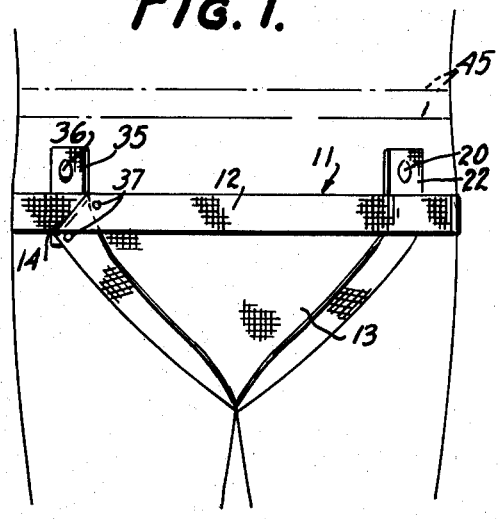
FIG. 2.
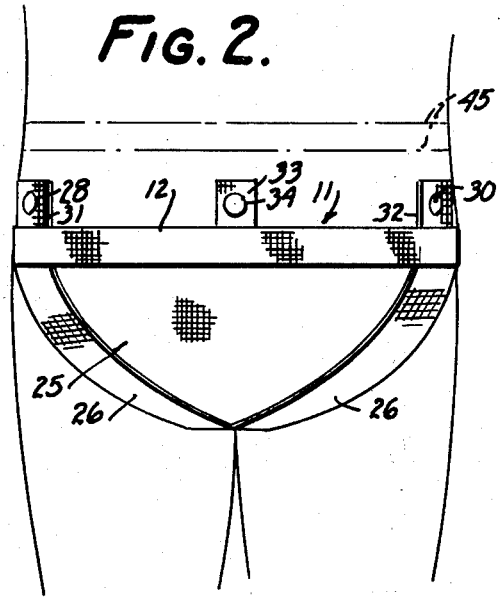
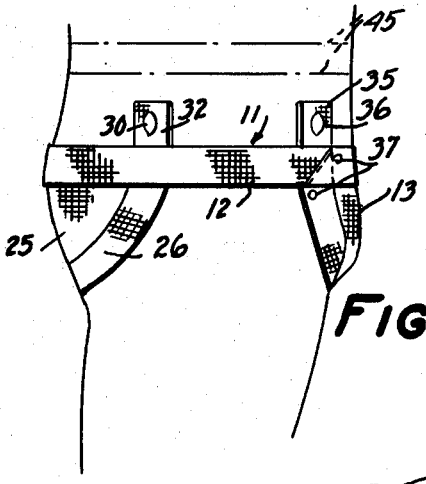
FIG. 3.
FIG. 6.
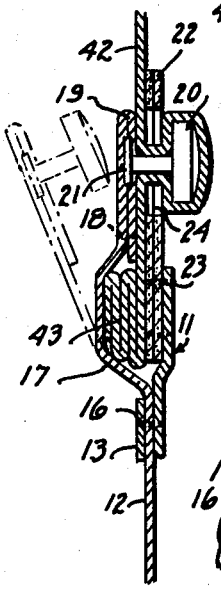
FIG. 7.
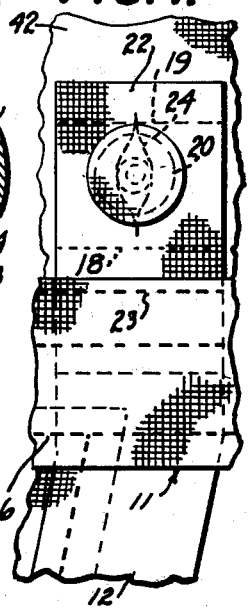
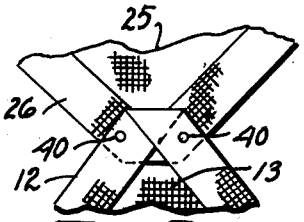
FIG. 5.
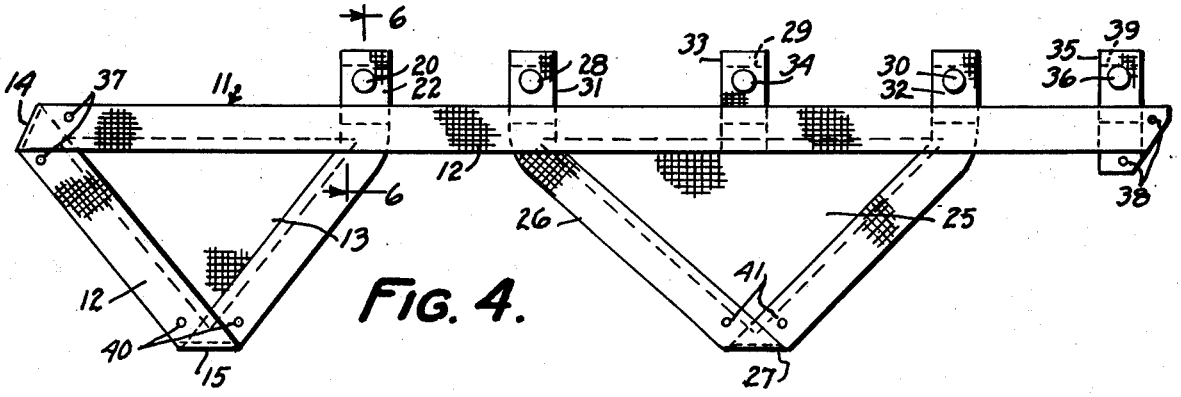
FIG. 4.

HOLD-DOWN DEVICE FOR SHIRTS AND THE LIKE

BACKGROUND OF THE INVENTION

1. Field of the Invention

This invention relates to hold-down devices for restraining the lower portion of a shirt, etc., from creeping up and bulging out of the trousers or other lower garment of the wearer.

2. Description of the Prior Art

Due to normal bending, sitting, walking and other body actions, there is a tendency for the lower portion of a shirt, etc., to creep upward from the trousers, thereby presenting an untidy or unkept appearance and requiring frequent tucking in of one's shirt, in the case of a male. The same applies to blouses, etc., worn by females.

Many devices have have been developed to hold a person's shirt within his trousers. Such devices generally take the form of straps or bands worn around the waist or crotch of the wearer. However, such devices must apply a constant downward pull on the shirt and therefore they are pulled upwardly by equal upward forces, resulting in uncomfortable concentrated stresses applied to different parts of the body, chafing, etc.

SUMMARY OF THE INVENTION

A principal object of the present invention is to overcome the above noted defects of prior devices of this nature.

Another object is to provide a shirt or blouse hold-down device which is comfortable to wear and yet effective to hold down a shirt or blouse at points substantially equally spaced around the body.

Another object is to provide a shirt hold-down device which can be readily removed along with the shirt.

Another object is to provide a shirt hold-down device which is simple and economical to manufacture and which may be readily laundered.

According to the basic aspects of the present invention. a hold-down device for a shirt is provided comprising an elastic hipband having front and rear elastic flaps secured thereto and converging downwardly to fit over the crotch area of the wearer. Upstanding tabs are attached along the length of the hipband and means are provided to removably attach the lower portion of the shirt to such tabs. Accordingly, an even downward pull is exerted around the shirt and such pull is evenly distributed throughout the lower area of the wearer's body to eliminate any concentrated areas of force which might otherwise cause discomfort, chafing, etc. Separable attaching means are provided to attach the lower ends of the flaps together and also to attach the ends of the hipband around the wearer's hips, wereby when such attaching means are separated, the wearer may easily remove the shirt with the hold-down device attached thereto.

BRIEF DESCRIPTION OF THE DRAWINGS

The manner in which the above and other objects of the invention are accomplished will be readily understood on reference to the following specification when read in conjunction with the accompanying drawing, wherein:

FIG. 1 is a front view showing a person wearing a shirt hold-down device embodying a preferred form of the present invention.

FIG. 2 is a rear view showing the hold-down device.

FIG. 3 is a side view showing the hold-down device.

FIG. 4 is a view of the hold-down device in extended position.

FIG. 5 is a bottom plan view showing the attaching means for the lower ends of the front and rear flaps.

FIG. 6 is an enlarged sectional view taken along the line 6—6 of FIG. 4 showing the lower portion of a shirt attached to one of the tabs.

FIG. 7 is a front view of the portion of the hold-down device depicted in FIG. 6.

DESCRIPTION OF THE PREFERRED EMBODIMENT

Figure 8:
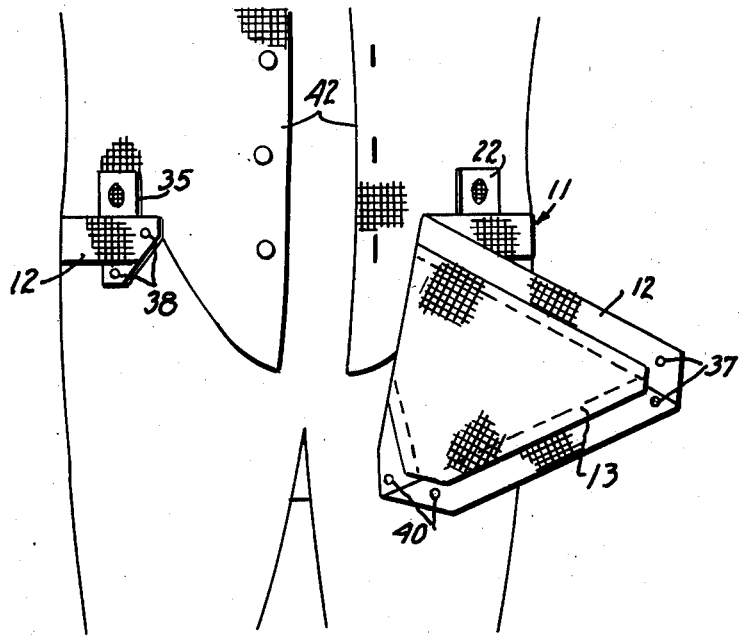
FIG. 8 is a front view showing the manner in which the hold-down device may be removed while still attached to a person's shirt.

Referring to the drawings, the hold-down device comprises a hipband 11 for completely surrounding the hips and formed by an elastic fabric band 12 capable of stretching in a longitudinal direction.

A triangular front flap 13 of elastic fabric, preferably capable of stretching in coordinate directions, is suitably stitched along its base edge to the hipband 11, as indicated at 16 in FIG. 6.

The left hand end of the band 12 is folded back on itself at 14, as depicted in FIG. 4, and again at 15 and is suitably stitched along the lower edges of the flap 13 to reinforce the same. The band 12 then continues upwardly and is suitably stitched to the hipband 11 by the above noted stitching 16. The remaining upwardly extending portion of the band 12 forms an elastic strip portion 17 which is folded back upon itself at 19 and stitched together as indicated at 18, FIG. 6. A button 20, which may be of conventional construction, is suitably secured to such folded over section 19 at 21.

A tab 22 of relatively stiff fabric and preferably of two plies is stitched at 23 to hipband 11 in a position directly facing the elastic strip portion 17 and has a button hole 24, FIGS. 6 and 7, formed therein to receive the button 20. It should be noted that the material of the tab 22 is elastic in a lateral or horizontal direction only and that the button hole 24 comprises a slit extending vertically.

A triangular flap 25, also of an elastic fabric preferably capable of stretching in coordinate directions, is suitably stitched along its base edge to the hipband 11 at a location spaced from the front flap 13. An elastic fabric band 26 is stitched along the lower edges of the flap 25 and is folded back upon itself at 27. The opposite ends of the band 26 are suitably stitched to the hipband 11 and extended upwardly therebeyond to comprise elastic strip portions which are formed in the same manner as depicted in FIG. 6. Buttons 28 and 30 are secured to such extending end portions of the band 26 to be received in button holes formed in tabs 31 and 32, respectively, which are stitched to the hipband 11 in a manner similar to that shown in FIG. 6. It should be noted that the section shown in FIG. 6 is typical of the sections including tabs 31 and 32.

A central tab 33 is suitably stitched to the hipband 11 midway beteen the tabs 31, 32 and has a button hole formed therein to receive a button 34 carried by a short elastic strip 29 suitably stitched to the hipband 11 and formed as depicted in FIG. 6, except that it terminates adjacent the lower edge of the hipband.

An additional upstanding tab 35 is stitched to the right hand end of the hipband 11 and is provided with a button hole to receive a button 36 attached to an elastic strip 39, similar to strip 29, but extending below the hipband 11.

Conventional snap type attaching elements 37 are suitably secured to the left hand end of the hipband 11 and mating snap type attaching elements 38 are secured to the right hand end thereof to interlock with elements 37 whereby to mount the hipband in a position surrounding a person's hips as shown in FIGS. 1 to 3. Similar interlocking attaching elements 40 and 41 are secured to the lower ends of the flaps 13 and 25, respectively, to attach such lower ends together as shown in FIG. 5, thereby causing the flaps to fit against the crotch and buttock area of the wearer.

In use, the hold-down device can be worn either as an under garment or it can be worn over a conventional under garment, and when in place, the lower portion of the wearer's shirt, as indicated at 42 in FIG. 6, is extended between the various tabs, i.e. 22, and the corresponding upper elastic strips, i.e. 17. The buttons, i.e. 20, are then pressed against the shirt material and into the mating button holes in the tabs to anchor the shirt against any upward creeping movement. Preferably, during such attachment, the device is stretched upwardly slightly so that in normal use, a downward pull is continuously applied to the shirt to hold it in place.

It will be seen in FIG. 6 that any excess amount of shirt material located between each tab and its associated elastic strip may be bunched or folded together as indicated at 43, the elastic material of the strip i.e. 17, enabling the same to stretch over any such bunched formation.

Any upward pull applied between the shirt and the device will be evenly distributed over the crotch area and buttocks of the wearer so that no concentrated point of pressure will be applied at any one place, allowing the device to be worn over long periods of time without discomfort. Also, it will be noted that most of the tabs i.e. 22, are secured to the upper extensions of the elastic reinforcing bands 12 and 26 to aid in evenly distributing any stresses or pulls applied by the shirt. Thus such stresses will be distributed more evenly throughout the flaps 13 and 25.

Since the button holes i.e. 24, in the tabs are vertically disposed and since the material of the tabs will not stretch vertically, the buttons will tend to wedge within the upper ends of such holes and there will be no tendency for the buttons to pull out in cases where abnormal pulling action may occur. However, since the tabs i.e. 22, may be stretched laterally, the buttons may be easily inserted or removed. The relative stiffness and upstanding condition of the tabs facilitates attachment of the shirt thereto.

By separating the snap attachment elements 37, 38 and 40, 41, as depicted in FIG. 8, the shirt may be removed in the usual manner with the hold-down device still attached thereto, thus obviating the need for the wearer to step out of the device.

The hold-down device is intended to be worn inside the trousers and since the waistband of the latter is generally located as shown by the dot-dash lines 45, above the hips, the buttons and other parts of the hold-down device will normally not be visible.

It will be obvious to those skilled in the art that many variations may be made in the exact structure shown without departing from the spirit or scope of this invention. For example, although the preferred embodiment has been described as used in association with men's clothing it will be obvious that it could, with possibly minor modification, be equally well used in association with women's clothing for the same purpose.

I claim:

1. A hold-down device for a shirt comprising
an elastic hipband for surrounding the hips of a wearer,
front and rear elastic fabric flaps secured to said hipband,
said flaps converging downwardly to fit the crotch of said wearer,
means attaching the lower ends of said flaps together,
upstanding tabs attached to said hipband and spaced therealong, and means for removably attaching the lower portion of said shirt to said tabs.

2. A hold-down device as defined in claim 1 wherein said tabs are non-elastic in a vertical direction,
said shirt attaching means comprising
elastic strips attached to said hipband adjacent respective ones of said tabs,
buttons on said strips, and
button holes in said tabs for receiving said buttons and portions of said shirt inserted in said button holes by said buttons.

3. A hold-down device as defined in claim 2 wherein said tabs are elastic in a lateral direction only and said button holes comprise
slits in said tabs,
said slits extending in a vertical direction.

4. A hold-down device as defined in claim 2 wherein said flap end attaching means comprises means removably attaching said flap ends together;
said hipband terminating in adjacent ends located between said front and rear flaps, and
means removably attaching said hipband ends together.

5. A hold-down device as defined in claim 2 comprising elastic bands secured to said flaps along the edges of said flaps,
said elastic bands being secured to said hipband, and
at least certain of said tabs being located at the junctures of said elastic bands and said hipband.

6. A hold-down device as defined in claim 5 wherein at least certain of said elastic strips comprise parts of said elastic bands.

* * * * *